US005271551A

United States Patent [19]

Roepke

[11] Patent Number: 5,271,551

[45] Date of Patent: Dec. 21, 1993

[54] CONTAINER

[76] Inventor: Gustav Roepke, Ruhrstrasse 114, 2000 Hamburg 50, Fed. Rep. of Germany

[21] Appl. No.: 730,962

[22] PCT Filed: Nov. 17, 1989

[86] PCT No.: PCT/EP89/01388

§ 371 Date: Jul. 18, 1991

§ 102(e) Date: Jul. 18, 1991

[87] PCT Pub. No.: WO90/05678

PCT Pub. Date: Mar. 31, 1990

[30] Foreign Application Priority Data

Nov. 18, 1988 [DE] Fed. Rep. of Germany ..... 8814572

[51] Int. Cl.[5] ..... B65D 5/46

[52] U.S. Cl. ..... 229/117.17; 229/157; 229/185

[58] Field of Search ..... 229/117.17, 178, 117.16, 229/165, 117.13, 157, 158, 155, 185

[56] References Cited

U.S. PATENT DOCUMENTS

| | | | |
|---|---|---|---|
| 2,865,553 | 12/1958 | Wasyluka | 229/117.17 |
| 2,954,914 | 10/1960 | Herlihy | 229/178 |
| 3,270,875 | 9/1966 | Burt | 229/165 |
| 4,037,777 | 7/1977 | Maughan | 229/165 |
| 4,392,607 | 7/1983 | Perkins, Jr. | 229/157 |
| 4,953,782 | 9/1990 | Noland | 229/157 |
| 5,046,662 | 9/1991 | Cowles | 229/157 |

FOREIGN PATENT DOCUMENTS

| | | | |
|---|---|---|---|
| 709720 | 5/1965 | Canada | 229/165 |

*Primary Examiner*—Allan N. Shoap
*Assistant Examiner*—Christopher J. McDonald
*Attorney, Agent, or Firm*—Gardner, Carton & Douglas

[57] ABSTRACT

A box formed of corrugated cardboard which is assembled in a reinforced manner so as to transport heavy objects such as books. An improved gripping hole is provided from an end wall extension twice folded over, resulting in a broader bearing surface. Disclosed are lid panels with a curved portion and a straight portion which interlock and prevent deformation. The bottom of the box is substantially reinforced by side wall extensions which are inserted through cutouts in end wall extensions and laid back to form substantially the entire inner bottom surface of the box.

8 Claims, 4 Drawing Sheets

CONTAINER

FIELD OF THE INVENTION

The present invention relates generally to a box capable of transporting relatively heavy objects, and more particularly to a sturdy and durable box with reinforcement features made of corrugated cardboard or similar material.

BACKGROUND OF THE INVENTION

Conventional cardboard boxes used to transport objects are frequently subjected to considerable stress, depending on what is transported in the box. If books or phonograph records are transported, for example, weights on the order of 400 to 500 pounds must be carried in a box with a volume of about 40 liters. These stresses do not affect the material of the box uniformly, rather, certain areas of the box experience substantial peak loads.

A prior art box is disclosed in U.S. Pat. No. 3,178,093 to Wasyluka, but it is not suitable for transporting relatively heavy objects. In another prior art box disclosed in U.S. Pat. No. 4,037,777 to Maughan, end walls of the box are each joined to an extension attached by a folding line. An inner, partially stamped portion of the extension, which in turn includes a partially stamped tab, reinforces the gripping hole of the box, but provides only a slight improvement in the properties of the box.

SUMMARY OF THE INVENTION

One object of the present invention is to achieve a better transmission of force from the gripping hole to the end wall and at the same time to reduce the strain on the hand. This object is achieved by means of the unique features of the present invention as disclosed herein and defined in the appended claims.

An important feature of the present invention is that it provides a gap on the order of several centimeters between the gripping hole and adjacent reinforcement members in the body of the box, allowing the gripping area to absorb and transmit greater forces. An important aspect of the invention is based on the recognition that the gripping area is a weak point of prior art boxes. By the improvements provided by the present invention, it is possible to increase the strength of a box by several times. Tests have shown that a box in accordance with the present invention can have a tear strength of about 400 to 500 pounds.

In a preferred embodiment of the present invention the gripping holes are formed with a centrally located bridge at a certain distance from reinforcement members, and the flaps of the box include cutouts centrally located in relation to their lateral boundaries.

In an alternative embodiment of the invention, the ends of the box are provided with an additional reinforcing element in the area between the base of a blank and an adjacent folding edge. By including such an additional reinforcing element it is possible to achieve even greater strength in the box.

When closing the lid of a conventional box it is often quite difficult to join the flaps correctly, because the prior art flaps may only be closed if they are deformed. As a result, permanent deformation ("dog-ears") frequently occurred. The present invention, however, corrects this defect of the prior art by providing flaps which may easily be closed by means of interleaved engagement of a curved portion of the flaps.

In another embodiment of the present invention, an end wall extension is twice folded over, thereby providing a broader bearing surface in the region of the gripping hole, which bearing surface has roughly the width of a suitcase handle. As a result, the gripping hole does not dig into the ball of the hand or the base of the fingers when the box is carried. This feature of the invention also provides a better transmission of force from the hand to the gripping hole, end wall and surface area of the box.

The box of the present invention may be constructed from a variety of materials, such as corrugated cardboard and solid board, appropriate plastics or combinations of materials.

BRIEF DESCRIPTION OF THE DRAWINGS

The invention is described in greater detail below by way of example with the aid of the drawings of which.

The figures show a box in accordance with the invention, namely a corrugated cardboard box which can, for example, be used to transport heavy objects such as books. The box may be formed in a conventional manner from a cardboard blank by means of folding, perforating, stamping and cut-outs.

DETAILED DESCRIPTION OF THE INVENTION

Figure 1:
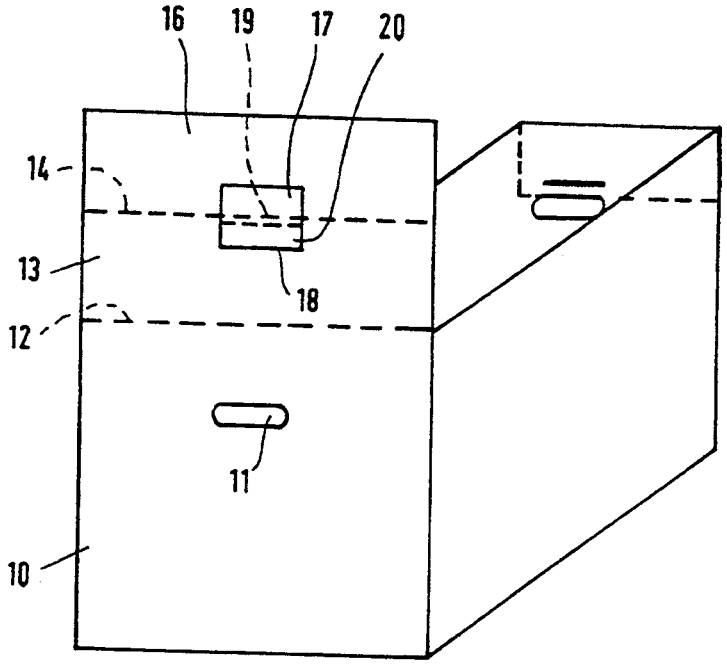
FIG. 1 is a perspective view of a box in accordance with the present invention.

Turning first to FIG. 1, the box of the present invention includes a gripping hole 11 in each of its end walls 10. The end wall 10 includes an upper extension which extends beyond folding line 12 and is comprised of two extension portions 13 and 16 of approximately the same size which are separated from each other by folding line 14. In the central area of the extension, in the vicinity of the folding line 14, is located a tab 17 with a folding line 19. This is formed by prior stamping at three boundary lines, the fourth boundary line being merely a folding line 18.

Figure 2:
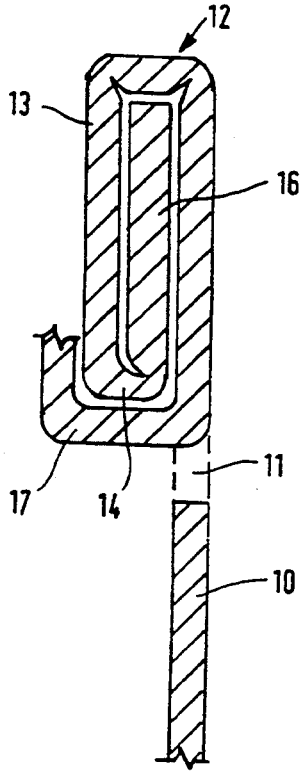
FIG. 2 is an enlarged view which depicts the details in the area of the gripping hole of a box in accordance with the present invention.

FIG. 2 shows how the extension portions 16 are folded over through 180° along the folding line 14, side portion 13 also being folded over through 180° along folding line 12. The tab 17, which is depicted in an alternative embodiment of the tab of FIG. 1, is formed in the end wall 10 in the area of the gripping hole 11. It can be seen that by means of this design of the gripping hole 11 and the tab 17, together with the folded over extension portions 13, 16, greater mechanical strength is provided by the box of the present invention, as well as a more comfortable gripping hole which includes a larger bearing surface.

Figure 3:
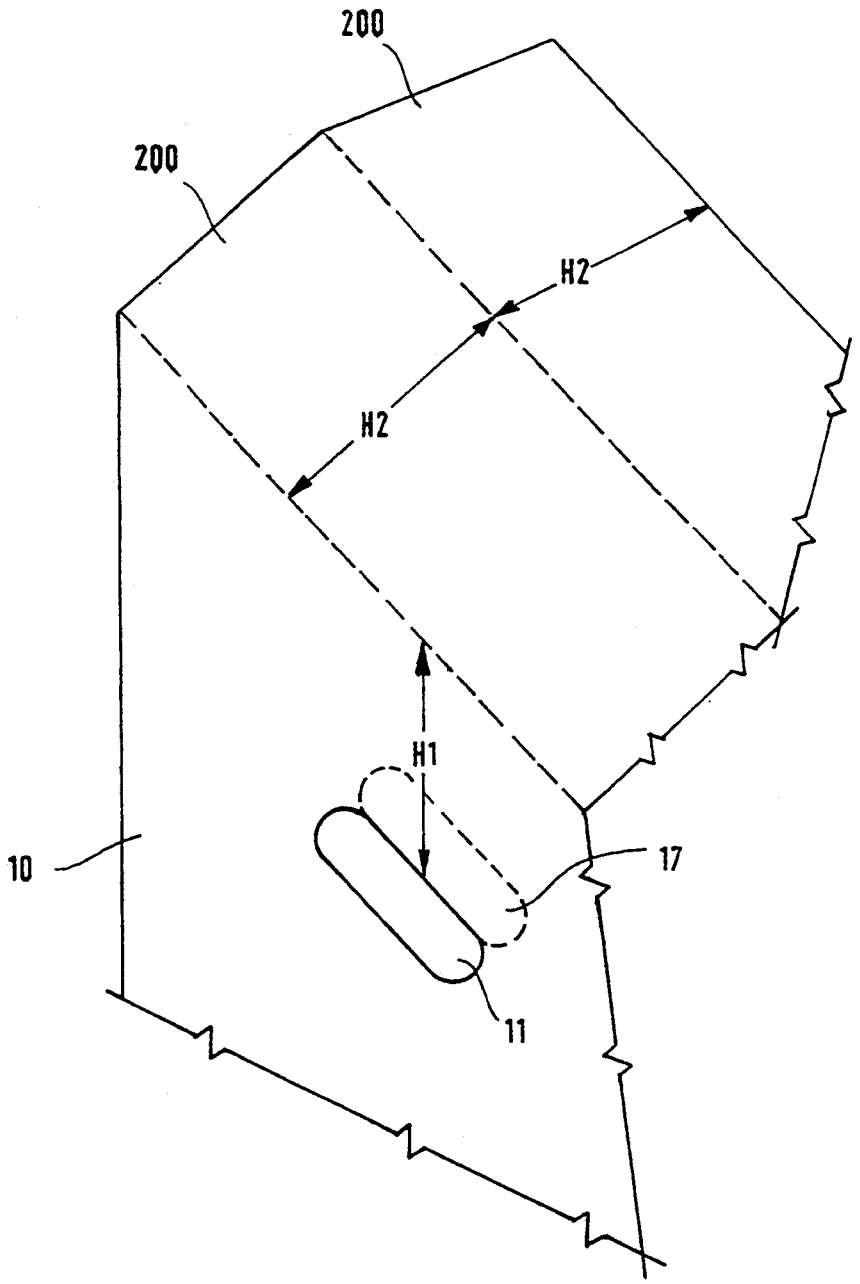
FIG. 3 is an enlarged view of the area of the gripping hole.

In a preferred embodiment as depicted in FIG. 3, the grip area of a box includes the upper boundary of the gripping hole 11 with a distance $H_1$ from the edge of the box. Side wall extensions 200 extending from the edge for a distance of $H_2$ in each case are folded over one another and back as previously described. Since $H_2$ is slightly greater than $H_1$, when the box is loaded, the force is first transmitted from the fold of the gripping hole to the folded-back side walls extensions 200 and only then, after a slight deformation of the gripping hole area, to the end wall 10.

Figure 4:
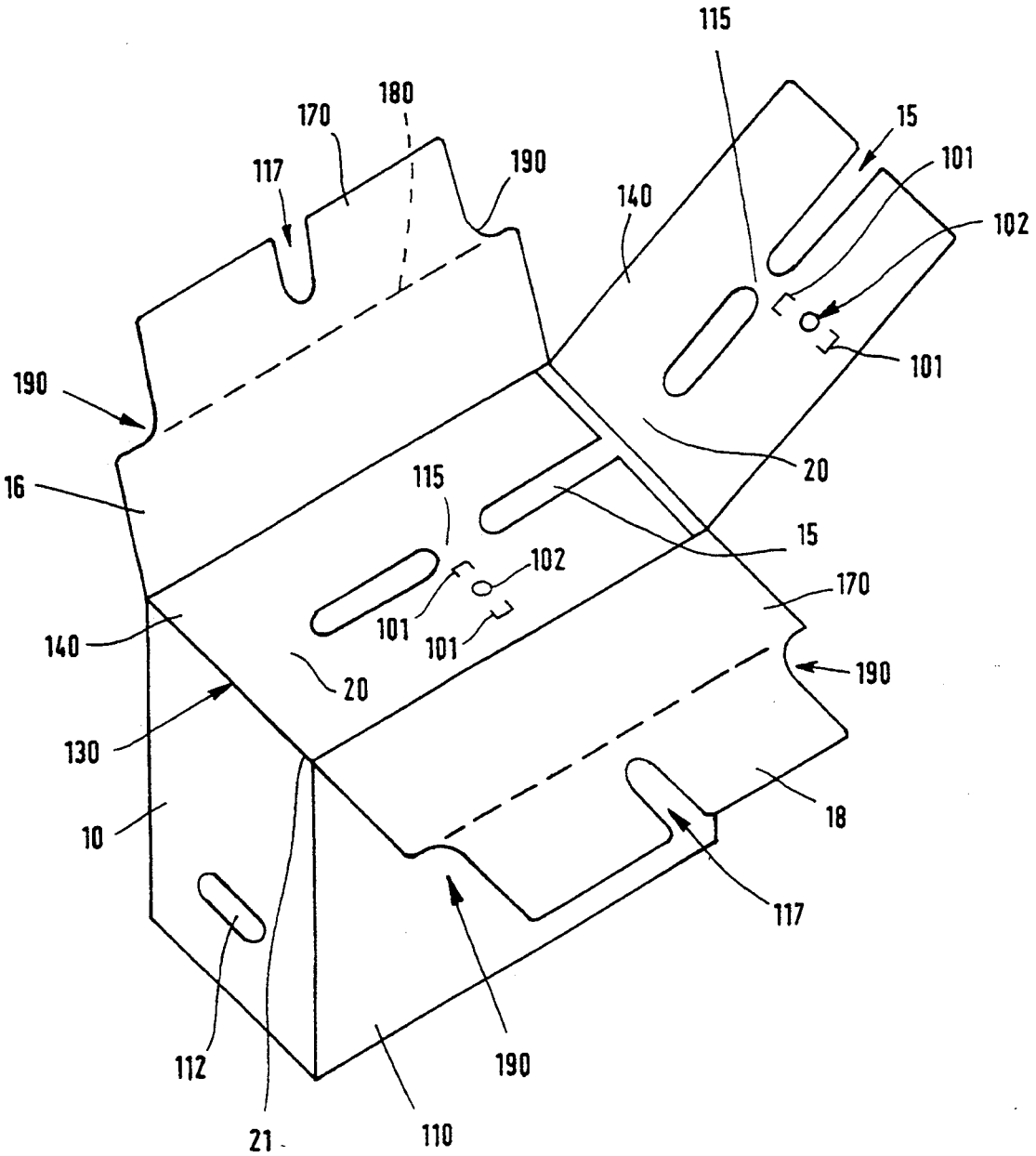
FIG. 4 is a bottom view of a box in accordance with the invention.

The bottom of the folding box as shown in FIG. 4 is shown before assembly is completed. One of the end walls is marked 10; the gripping hole in the end wall 10 is marked 112; the walls of the box have lower extensions which are marked 140, 16 and 170.

The lower extensions of the end walls 10 are formed with a slit or cutout 15 which extends along the longitudinal axis of the box but does not continue as far as the adjacent folding edge 21, such that a gap remains which acts as a reinforcing bridge, wherein the reference number 130 indicates the particularly critical point of strain.

One lower end wall extension 140 is already in its final position, and the other lower end wall extension 140 has yet to be placed over the other extension. Stamped-out holes 102 are located in the region of the flaps 101 in the end wall extensions 140, and in the area of each of the holes 102 there are preferably provided two flaps 101. Then the two side wall extensions 16, 170 will likewise be folded inwards, the flaps being folded along folding lines 180, inserted through the cutouts 15 and laid back inside the box. The flaps of the side wall extensions 170 include cutouts 190.

The area 115 of the lower extension of the end walls 10 defines a bridge which interrupts the cutouts 15 at a predetermined distance from the end of the extensions. At the corresponding points in the side wall extensions 170 are cutouts 117 such that it is possible to assemble the box.

The extensions 140 include stamped flaps 101 which, when the box is finally assembled and turned upright, lie above punched-out holes 102, thereby attaching the side wall extensions 140 to one another.

Figure 5:
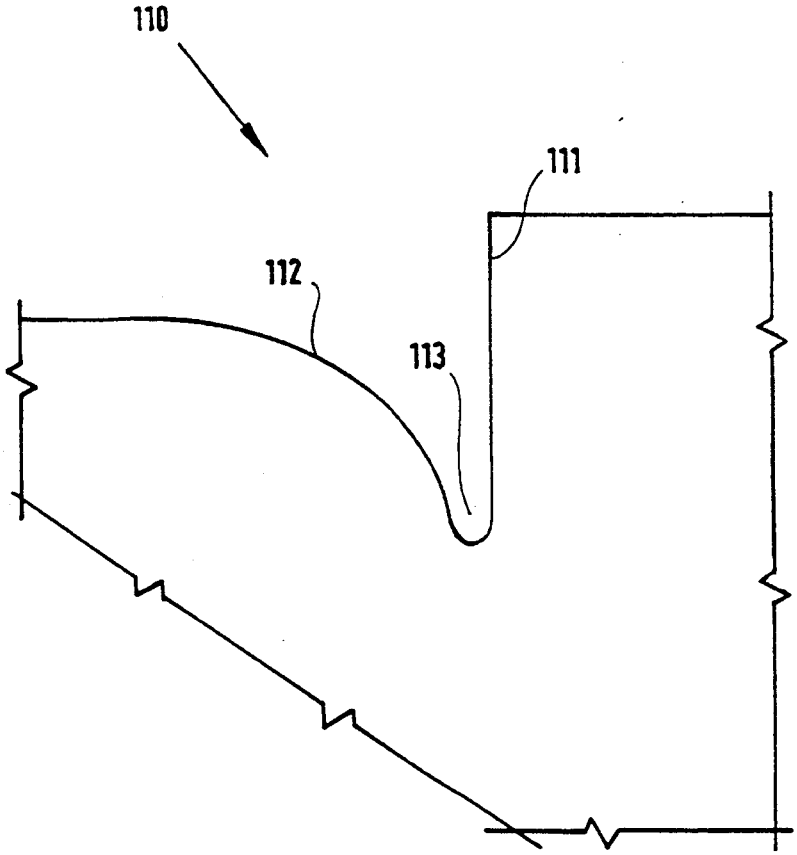
FIG. 5 is a top view which depicts features of the lid of a box in accordance with the present invention.

The lid of the box in accordance with the present invention is shown in FIG. 5 and is provided with two flaps extending from the sides of the box which lie opposite one another and are provided with slits 110. In the state of the prior art these are slits in which the two edges are straight and parallel.

In the present invention, by contrast, the lid panels each include a slit 110, and one side boundary of each slit has a curved shape 112 in the form of an arc, circle, evolvement or an exponential function, as illustrated in FIG. 5.

The curved boundary 112 of one of the flaps lies opposite the straight boundary 111 of the other flap and vice versa. When the box is to easily be closed in accordance with the invention, the curved design allows the flaps to be closed by interleaved engagement, arriving more or less unaided in the closed position. The closed position of the flaps is stable as a result of the base 113 of the slit. Nevertheless the box can without difficulty be opened and reused several times without having to deform the flaps.

I claim:

1. A box comprised of four walls joined to form a continuous ring, wherein two of said four walls are opposing walls which each include a gripping hole and an extension section which is separated from its respective wall by a first folding line, wherein each of said extension sections are comprised of a first extension portion and a second extension portion of approximately the same size which are separated from one another by a second folding line, wherein a tab which is partially stamped and folded out from said extension section extends through said gripping hole, wherein said first extension portion is folded back with respect to said second extension portion along said second folding line by approximately 180°, and each of said extension sections is folded back with respect to said respective wall along said first folding line by approximately 180° whereby said second folding line is disposed in the vicinity of said gripping hole.

2. A box as set forth in claim 1 which further includes a lid comprised of two opposing flaps with lateral slits which define two boundaries of each of said flaps, wherein one of said two boundaries of each of said flaps has a curved shape in the form of an arc of a circle, an evolvement or an exponential function.

3. A box comprised of four walls, two opposing side walls and two opposing end walls, joined to form a continuous ring, wherein said box includes a bottom formed from four respective extensions, two side wall extensions and two end wall extensions, of said four walls, wherein each of said extensions is separated from its respective wall by a folding line, wherein the two end wall extensions each include a centrally oriented cutout, extending in a direction from the folding line of the end wall extension to the opposing edge of the end wall extension, for inserting a trimmed portion of the said side wall extensions, wherein the trimmed portions of said side wall extensions are inserted through said centrally oriented cutouts of said end wall extensions and laid back to form substantially the entire inner bottom surface of the box, wherein said end wall extension cutouts terminate at a distance of several times the thickness of the material of the box from the respective folding line of the said end wall extension and include a centrally located bridge which interrupts the cutouts, wherein each of said side wall extensions include a centrally located cutout which engages with the bridges of the cutouts of the said side wall extensions.

4. A box as set forth in claim 3 wherein each of said end wall extensions include a reinforcing bridge in the region between the base of the cutout and the respective adjacent folding line.

5. A box as set forth in claim 3 wherein each of said end wall extensions include one or more flaps which are located in engagable relation to each other.

6. A box as set forth in claim 5 wherein a hole in each of said end wall extensions is located in the region of said flaps.

7. A box as set forth in claim 5 wherein there are a pair of said flaps.

8. A box as set forth in claim 3 which further includes a lid comprised of two opposing flaps with lateral slits which define two boundaries of each of said flaps, wherein one of said two boundaries of each of said flaps has a curved shape in the form of an arc of a circle, an evolvement or an exponential function.

* * * * *